United States Patent [19]

Rubin

[11] Patent Number: 4,692,032

[45] Date of Patent: Sep. 8, 1987

[54] ORBIT CLOCK

[76] Inventor: Kenneth Rubin, 33 College Pl., Brooklyn Heights, N.Y. 11201

[21] Appl. No.: 900,286

[22] Filed: Aug. 25, 1986

[51] Int. Cl.[4] ..... G04B 19/00; G04B 25/00

[52] U.S. Cl. ..... 368/76; 368/223

[58] Field of Search ..... 368/62, 76–78, 368/220–222, 223, 228, 233, 235

[56] References Cited

U.S. PATENT DOCUMENTS

| | | | |
|---|---|---|---|
| Re. 30,987 | 6/1982 | Jones | 368/76 |
| 1,959,831 | 5/1934 | Krzeminski | 368/26 |
| 2,023,677 | 12/1935 | Fowler | 368/24 |
| 2,051,611 | 8/1936 | Liner | 360/77 |
| 3,675,411 | 7/1972 | Sakuma | 368/27 |

*Primary Examiner*—Vit W. Miska

*Attorney, Agent, or Firm*—Amster, Rothstein & Ebenstein

[57] ABSTRACT

A clock design incorporates both digital and analog aspects. An "hour" ball riding a vertically oriented spiral raceway is lifted in a straight line from the bottom of the outer spiral to the bottom of the inner spiral as the raceway rotates at the rate of one revolution per hour, its presence on a given spiral constituting a digital selection of the hour associated with that given spiral. A "minute" ball is fixedly mounted on the raceway periphery, its rotational orientation constituting an analog selection of the minutes.

15 Claims, 4 Drawing Figures

ORBIT CLOCK

BACKGROUND OF THE INVENTION

The present invention relates to apparatus for telling time, such as clocks and calendars, and more particularly relates to novel apparatus of that type having both digital and analog aspects.

Strictly analog clocks present certain difficulties to children first learning to read them. For example, if the correct time is 2:30, the child has no trouble with the minute portion of the time because the minute hand is pointing exactly to the 30-minute indicator; however, the hour hand is confusing because it is not pointing at the two hour indicator but rather at a location midway between the two and the three hour indicators.

A further difficulty encountered in teaching children to tell time is that the child rapidly gets bored as, despite an abundance of superficial variations in their detail, most analog clocks function on similar principles and appear functionally equivalent. Indeed, this boring sameness among analog clocks is depressing not merely to children, but to adults as well. Clear evidence of this is found in watch pieces and clocks such as those which incorporate on the face one or more rotating spirals to provide an interesting background for an otherwise completely conventional analog hand and face arrangement.

Accordingly, it is an object of the present invention to provide apparatus for telling time which incorporates both analog and digital features.

Another object is to provide such apparatus which is both easy and interesting for children to use as they learn to tell time.

A further object is to provide such apparatus which is of such strikingly novel design and functionality that it makes a novel aesthetic statement and is therefore desirable for use even when children are not present.

Yet another object is to provide such apparatus which is of simple, reliable and rugged construction, yet economical to manufacture and maintain.

SUMMARY OF THE INVENTION

It has now been found that the above and related objects of the present invention are achieved in a timekeeping apparatus, such as a clock or calendar, which incorporates both analog and digital features. More particularly, the apparatus comprises a rotatable spiral raceway having an inner spiral, an outer spiral and a plurality of intercommunicating intermediate spirals therebetween. Means are provided for supporting the raceway in a vertical orientation and for rotating that raceway in a given direction at a given rate (that is, a given number of rotations in a given unit of time). A first indicator means, such as a ball, is mounted within the raceway and adapted for movement relative thereto along the spirals under the influence of gravity as the raceway rotates. The apparatus further comprises a vertically extending set of indicia and means for associating each of the indicia with each of the spirals. Rotation of the raceway causes the first indicator means to be lifted in a straight line from the bottom of the outer spiral to the bottom of the inner spiral, the presence of the first indicator means in a given spiral being a selection of the indicia associated with that spiral.

Preferably a vertically extending pathway provides communication for the first indicator means between the inner and outer spirals, gravity causing the return of the first indicator means from the end of the inner spiral through the passageway to the beginning of the outer spiral. A second indicator means is preferably mounted on the raceway for rotary movement therewith, the disposition of the second indicator means providing information in addition to that provided by said indicia.

A preferred embodiment of the present invention comprises a clock. In this embodiment, the raceway defines a multiple of twelve full spirals, typically just twelve full spirals with the associating means associating the numeral "11" with the inner full spiral and the number "12" with the outer full spiral. The rotating means rotates the raceway in the clockwise direction at the rate of one spiral per hour, the associating means associates the indicia of specific hours with respective ones of such spirals, and the first and second indicator means indicate hours and minutes, respectively. Preferably the second indicator means is mounted on the outer periphery of the raceway, outwardly of the associating means so that the travel path of the second indicator means is not intercepted by the associating means.

Generally, in embodiments having the pathway, the first indicator means and the pathway are disposed on opposite faces of the raceway, the pathway being configured and dimensioned to enable the first indicator means to travel from the inner spiral to the outer spiral under the influence of gravity.

To facilitate reading of the indicia indicated by the first indicator means, the associating means gradually raises each of the indicia a fixed distance as the rotating means rotates the raceway and then sharply returns each of the indicia to its original level upon completion of a full rotation. In this manner, the associating means maintains one of the indicia at the same vertical level as the first indicator means as the rotating means rotates the raceway through a full rotation, thereby to uniquely identify the indicium for the particular full rotation. Such associating means perferably comprises a cam centrally disposed for rotation therewith. The set of indicia comprises a strip containing indicia disposed in vertical alignment, the strip being suspended from and its vertical level determined by the cam. Either the strip or the first indicator means is transparent, the strip preferably being transparent (except for the indicia) and disposed in front of the raceway and the first indicator means. A preferred first indicator means comprises an opaque member rotatable along the raceway, such as an opaque ball, and viewable through the transparent strip.

Another preferred embodiment of the present invention, one not requiring a second indicator means, comprises a monthly calendar which indicates the particular day of the month. In such an embodiment, the raceway defines 31 spirals, the rotating means rotates the raceway at the rate of one spiral per day, the associating means associates the indicia of specific days of the month with respective spirals, and the first indicator means indicates days. In such a monthly calendar embodiment, as is the case with many date and time watches, manual intervention is required in the case of short months.

BRIEF DESCRIPTION OF THE DRAWING

The above brief description, as well as further objects and features, will be more fully understood by reference to the following detailed description of the presently preferred, albeit illustrative, embodiments of the present invention when taken in conjunction with the accompanying drawing wherein.

DETAILED DESCRIPTION OR THE PREFERRED EMBODIMENTS

Figure 2:
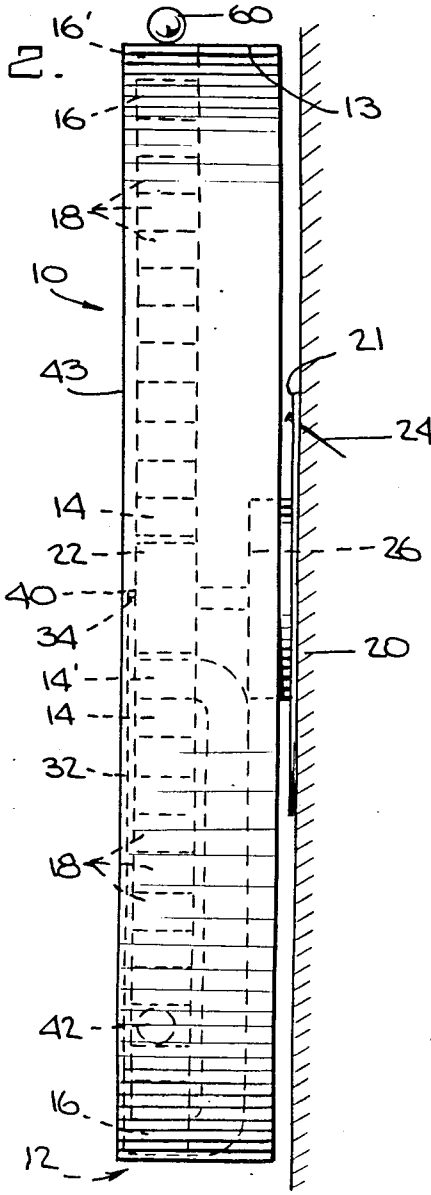
FIG. 2 is a side elevation view of the clock attached to a wall.
Figure 1:
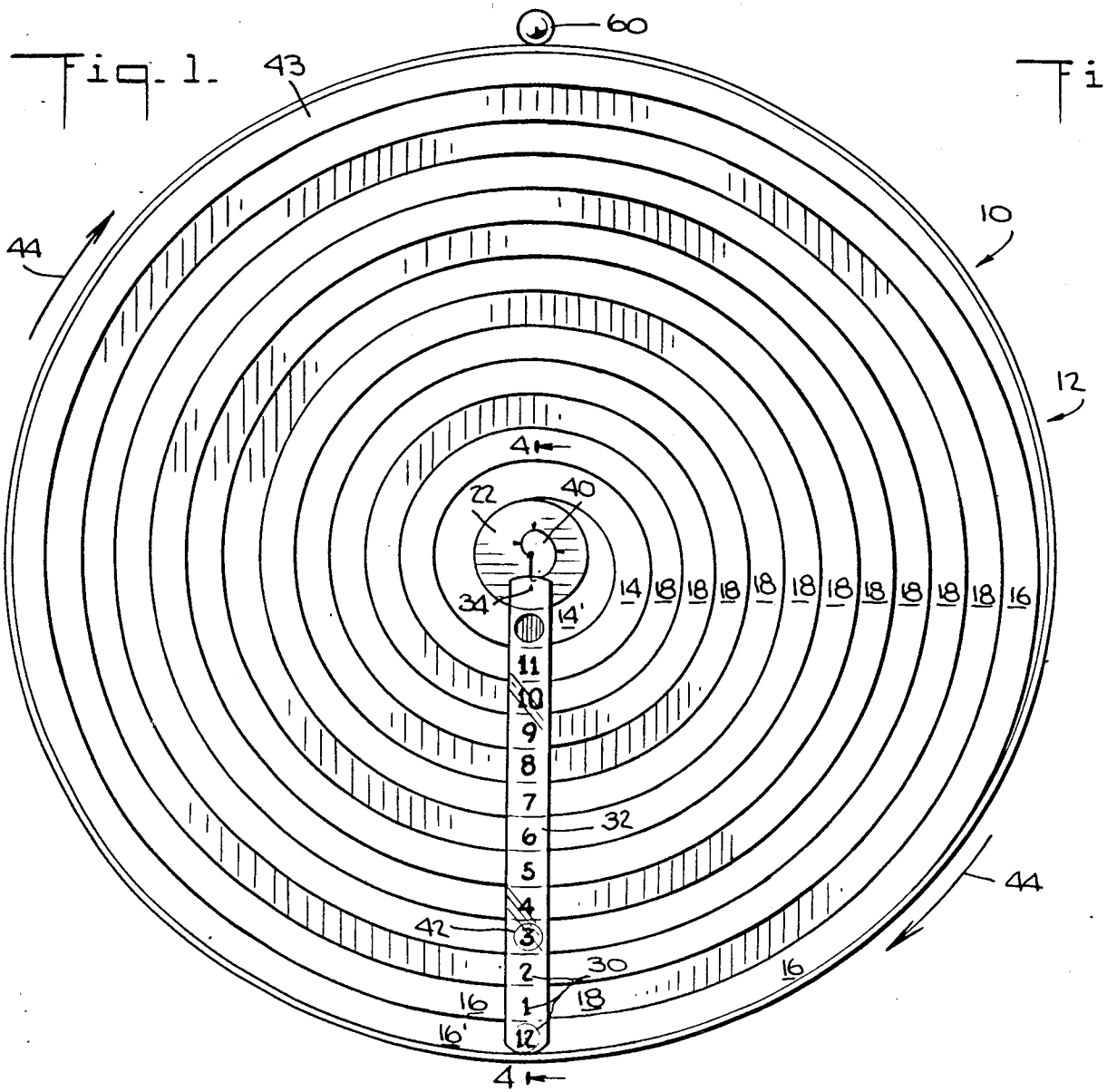
FIG. 1 is a front elevation view of a clock according to the present invention.

Referring now to the drawing, and in particular to FIGS. 1 and 2 thereof, therein illustrated is a clock, generally designated by the element numeral 10, according to the present invention. The face of the clock 10 comprises a vertically oriented rotatable spiral raceway generally designated 12, disposed within a stationary open faced cylindrical support frame 13. The raceway 12 defines an inner full spiral 14, an outer full spiral 16 and a plurality of intercommunicating intermediate full spirals 18 therebetween. While only twelve full sprials (including the inner spiral 14 and outer spiral 16) are shown here, in a clock adapted to give military or 24-hour readings, the raceway would define 24 full spirals. Partial spirals—i.e., spirals not making a full revolution spiral—extend outwardly from outer spiral 16 and inwardly from inner spiral 14, the width of these partial spirals tapering down to provide the raceway a circular interior and exterior.

To maintain the raceway 12 vertical, it is supported on a vertical surface, such as a wall 20, by a backing plate 21 connected to the wall by a nail 24 or other conventional means of attachment. A battery-driven lightweight motor 26 extending through frame 13 is mounted on the backing plate 21 and supports the central hub 22 of the raceway 12, the motor 26 being adapted to rotate the hub 22 and therefore the entire raceway 12 at the rate of one spiral per hour. (Of course, alternatively the motor 26 may be of the conventional AC type energized by a wall outlet, if desired.)

In order to associate each of the spirals 14, 16 or 18 with a given hour of the day, a vertically extending set of twelve opaque indicia 30 are provided on a vertically extending strip 32. The height of each indicium 30 is preferably just about sufficient to occupy the gap between the bottoms of adjacent spirals. The indicia begin with "12" at the outer spiral 16, then commence with "1" on the next inward spiral 18 and progress upwardly from there, terminating with "11" at the inner spiral 14.

Figure 3:
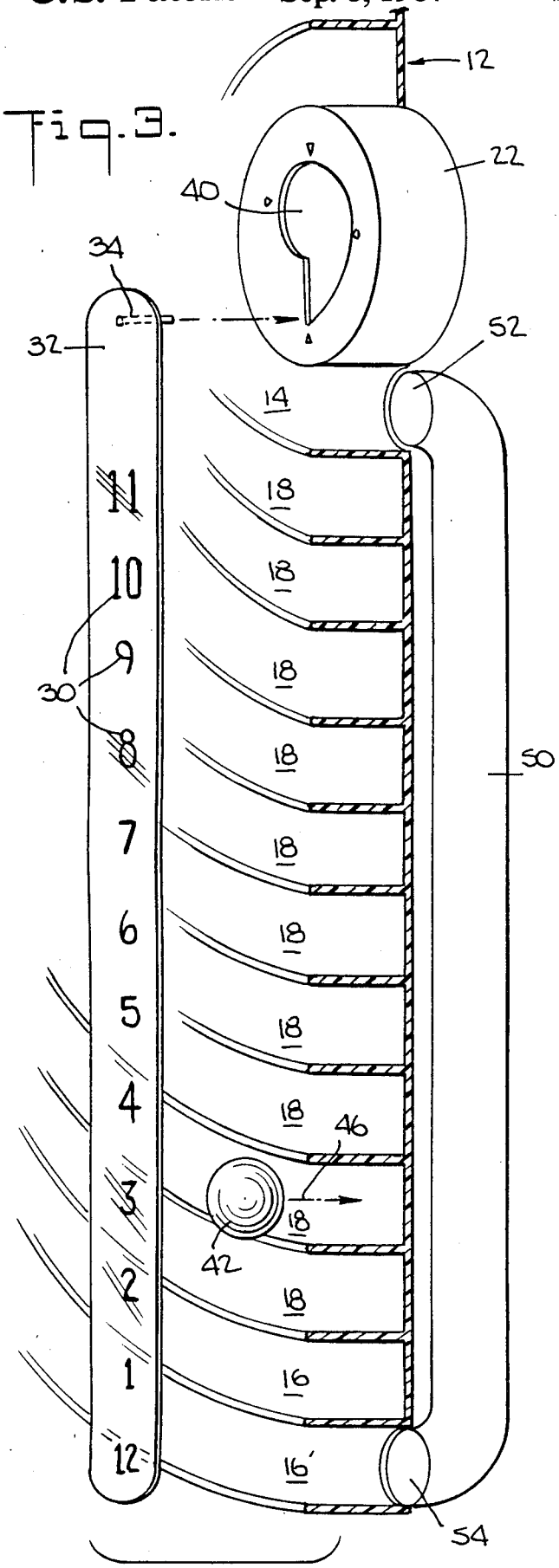
FIG. 3 is fragmentary, partially exploded isometric view of the clock, to an enlarged scale.

Central hub 22 is centrally apertured to define an internal cam 20 which rotates with the hub 22. The strip 32 is suspended from a camming pin 34 which rides the periphery of the cam 40 so that the vertical level of the strip 32, and therefore the indicia 30 disposed in vertical alignment thereon, is determined by the rotational orientation of the cam 40 (which corresponds to the rotational orientation of the hub 22 and raceway 12). The surface of the cam 40 on which the strip 32 rides is configured and dimensioned so as to gradually raise the strip and indicia thereon a fixed distance as the rotating means or motor 26 slowly rotates the raceway 12, and then permit gravity to quickly return the strip and indicia to their original level upon completion of the full rotation. To this end, the cam 40 has a caming surface somewhat resembling a comma, as best seen in FIGS. 1 and 3.

Figure 4:
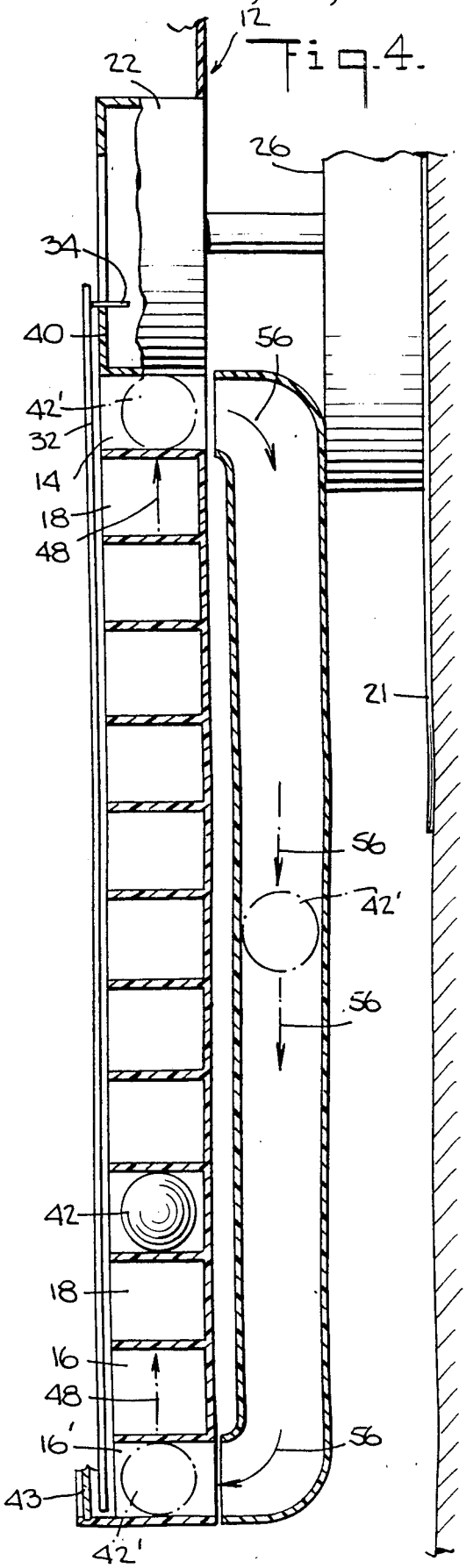
FIG. 4 is a fragmentary side elevation view of the clock taken along the line 4—4 of FIG. 1, to an enlarged scale, and with the transparent panel removed, with the first indicator means being illustrated in phantom line returning from the inner spiral through the passageway to the outer spiral.

A first indicator means, such as the ball 42 (shown behind the indicium "3" in FIG. 1), is mounted within the raceway 12 and adapted for movement relative thereto along the spirals 16, 18, 14 under the influence of gravity as the raceway rotates. Thus, as the raceway 12 rotates in the clockwise direction (as indicated by the arrows 44 in FIG. 1), the ball 42, by simply staying in place with respect to the rotation, travels relatively in the opposite direction (see arrow 46 in FIG. 3). More particularly, gravity acts to maintain the ball 42 at the bottom point of each spiral as the spiral moves so that rotation of the raceway effectively causes the ball 42 to be lifted in a straight line from the bottom of the outer spiral 16, along the intermediate spirals 18, to the bottom of the inner spiral 14 (as shown by the arrow 48 of FIG. 4). The ball 42 may be any member (such as a cylinder) rotatable along the raceway and of sufficient weight that it remains in place despite the minimal frictional forces which may tend to carry the ball 42 along the spiral on which it rests. The presence of the ball 42 in a given spiral 14, 16 or 18, constitutes a selection of the indicium associated with the spiral—namely, a selection of the specific hour. It will be appreciated that the action of cam 40 maintains the indicia associated with that particular spiral at the same vertical level as the ball 42 as the motor 26 rotates the raceway 12 through substantially a full rotation, thereby uniquely identifying that indicium or hour for the particular full rotation. Thus, when the ball 42 is indicating the hour of "3", the ball 42 indicates the "3" in the same manner fom 3:00 o'clock through 3:59 o'clock (with the cam 40 lifting the strip 32 and the indicium "3" thereon at precisely the same rate as the ball 42 is lifted by the spiral 18). At 4 o'clock exactly, the cam 40 drops the strip 32 the same distance it previously raised it so that the indicium "4" is now at the same vertical level as the ball 42. Now the ball 42 and the indicium "4" begin their simultaneous journey upward, the former under the influence of the spiral 18 and the latter under the influence of the cam 40.

Preferably the strip 32 is transparent except for the opaque indicia 30 and disposed in front of the raceway 12 and the opaque ball 42. A broad variety of other interactions between the ball 42 and the strip 32 are possible without detracting from the ability of the ball 42 to denote a particular indicium 30. For example, the ball 42 may be transparent but colored, or the strip 32 may be opaque and the ball 42 of sufficient diameter to enable it to be seen protruding from behind the strip to the sides thereof.

To prevent escape of the ball 42 from the raceway 12, a transparent panel 43 (see FIG. 2) may be removably mounted in the raceway, the panel being removed in order to "set" the hour indicator by appropriate placement of the ball 42 on the appropriate spiral 14, 16 or 18. The panel 43 is, of course, unnecessary where the strip 32 is of sufficient weight and strength to restrain ball 42 from accidentally falling out of the raceway 12 as a result of vibration, accidental jostling or the like.

In order to provide for return of the ball 42 from the inner spiral 14 to the outer spiral 16 at the end of a twelve hour cycle, there is a vertically extending passageway or pathway 50 defining an entry port 52 disposed at the end of the inner spiral 14 (actually the beginning of the partial spiral 14' disposed inwardly of inner spiral 14) and an exit port 54 disposed at the beginning of outer spiral 16. Thus, at 12:00, the ball 42, having completed its travel along the length of inner spiral 14 associated with the indicium "11", enters entry port 52 is caused by gravity to drop through passageway 50, and exits exit port 54 onto the beginning of outer spiral 60, where its interaction with the indicia 30 indicates that the indicium "12" is selected. The path of travel of ball 42 through passageway 50 is clearly indicated in FIG. 4 by the phantom-line ball 42', and the arrows 56. The passageway 50 is preferably disposed on the opposite face of the raceway 12 from the ball 42 so that the bulk of passageway 50 is not visible to a viewer and the ball 42 appears to simply disappear from the inner spiral, and as if by magic, appear at the outer spiral at the appropriate time.

It will be appreciated that in a "month calendar" embodiment of the present invention wherein there are 31 spirals 14, 16 and 18 and indicia 30 ranging from "1" at the bottom through "31" at the top, some manual intervention will be required in the case of short months, as is the present practice with calendar watches. In such an embodiment, the motor 26 is geared so that a full rotation of the raceway requires a full day and, at the end of the last day of a short month, the ball 42 may simply be dropped into the entry port 52 or manually placed adjacent the exit port 54.

Returning now to the clock embodiment of the present invention, a second indicator means, such as ball 60, is fixedly mounted on the raceway 12 for rotation therewith, the disposition of the ball 60 providing information in addition to that provided by the indicia 30 on the strip 32. More specificially, the ball 60 acts as a minute hand, its spatial orientation on an imaginary clock face showing the minutes. If desired, a clock face arrangement may be provided with the clock face extending outwardly from the outer periphery of raceway 12 so that the number of minutes may be more precisely determined by the interaction of the ball 60 and the clock face numerals. Especially if the clock is being used to instruct children, it is desirable that the clock face indicate not the hours "1" through "12", but rather the minutes "1" through "60", a feature possible because the hours are indicated digitally. The second indictor means 60 can be provided in a variety of shapes and may be mounted other than on the outer periphery of the raceway- 12, the only limitation being it be mounted outwardly or to the rear of the associating means 32 so that its travel path is not intercepted by the associating means.

To set a clock according to the present invention, the raceway 12 is simply rotated in a clockwise direction to position the second indicator means 60 at the appropriate orientation for the minutes, this motion having the effect of properly positioning the cam 40 and the indicia-carrying strip 32. Then the first indicator means 42 is simply placed on the spiral associated with the correct indicium 30 for the hours. The ball 42 can be placed on either side of the strip 32, and gravity will cause the ball 42 to travel to the bottom position of the spiral, as desired. If a transparent window 43 has been provided, the window need simply be lifted or temporarily moved for the setting operation.

To summarize, a clock according to the present invention incorporates both digital and analog features, the hour selection being determined in digital fashion by the interaction of the first indicator means and the indicia on the strip and the minute selection being determined in analog fashion by the angular orientation of the second indicator means. The digial hour feature and the possibility of having the minute hand indicator travel along a clockface indicating minutes as "1" through "60" render the apparatus both easy and interesting for children to use as they learn to tell time. Furthermore, the clock is of such strikingly novel design and functionality that it make an aesthetic statement and is therefore desirable for use even when children are not present. The clock is of simple, reliable, and rugged construction, yet economical to manufacture and maintain.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing disclosure.

What is claimed is:

1. Apparatus comprising (A) a rotatable spiral raceway having an inner spiral, an outer spiral, and at least one intercommunicating intermediate spiral therebetween;

(B) means for supporting said raceway in a vertical orientation;

(C) means for rotaing said raceway in a given direction at a given rate;

(D) first indicator means mounted within said raceway and adapted for movement relative thereto along said spirals under the influence of gravity as said raceway rotates;

(E) a vertically extending set of indicia; and (F) means for associating each of said indicia with respective spirals;

whereby rotation of said raceway causes said first indicator means to be lifted in a straight line from the bottom of said outer spiral to the bottom of said inner spiral, the presence of said first indictor means in a given spiral being a selection of the indicium associated with said spiral.

2. The apparatus of claim 1 wherein a vertically extending pathway provides communication for said first indicator means between said inner and outer spirals, whereby gravity causes the return of said first indicator means from the bottom end of said inner spiral through said passageway to the bottom beginning of said outer spiral.

3. The apparatus of claim 1 further comprising second indictor means mounted on said raceway for rotary movement therewith, the disposition of said second indicator means providing information in addition to that provided by said indicia.

4. A clock according to the apparatus of claim 3 wherein said raceway defines a multiple of twelve spirals, said rotating means rotate said raceway in the clockwise direction at the rate of one spiral per hour, said associating means associates the indicia of specific hours with respective ones of said spirals, and said first and second indicator means indicate hours and minutes, respectively.

5. The clock of claim 4 wherein said second indicator means is mounted on the outer periphery of said raceway.

6. The clock of claim 4 wherein said second indicator means is mounted outwardly of said associating means, whereby the travel path of said second indicator means is not intercepted by said associating means.

7. The clock of claim 4 wherein said raceway defines twelve spirals and said associating means associates the numeral 11 with said inner spiral and the numeral 12 with said outer spiral.

8. The apparatus of claim 2 wherein said pathway and said first indicator means are disposed on opposite faces of said raceway.

9. The apparatus of claim 2 wherein said pathway is configured and dimensioned to enable said first indicator means to travel from said inner spiral to said outer spiral under the influence of gravity.

10. The apparatus of claim 1 wherein said associating means gradually raises each of said indicia a fixed distance as said rotating means rotates said raceway and sharply returns each of said indicia to its original level upon completion of a full rotation.

11. The apparatus of claim 10 wherein said associating means maintains one of said indicia at the same vertical level as said first indicator means as said rotating means rotates said raceway through substantially a full rotation, thereby to uniquely identify said indicium for said particular full rotation.

12. The apparatus of claim 11 wherein said associating means comprises a cam centrally disposed in said raceway and adapted for rotation therewith, and said set of indicia comprises a strip containing indicia disposed in vertical alignment, said strip being suspended from and its vertical level determined by said cam.

13. The apparaus of claim 12 wherein one of said strip and said first indicator means are transparent.

14. The apparaus of claim 13 wherein said strip is transparent except for said indicia and disposed in front of said raceway and said first indicator means.

15. The apparatus of claim 14 wherein said first indicator means comprises an opaque member rotatable along said raceway.

* * * * *